US008931985B2

(12) United States Patent
Nooren

(10) Patent No.: US 8,931,985 B2
(45) Date of Patent: Jan. 13, 2015

(54) SYSTEM AND METHOD FOR MODULARIZATION OF A SCHNABEL CAR

(71) Applicant: Piet Nooren, Angleton, TX (US)

(72) Inventor: Piet Nooren, Angleton, TX (US)

(73) Assignee: Mammoet USA South, Inc., Rosharon, TX (US)

( * ) Notice: Subject to any disclaimer, the term of this patent is extended or adjusted under 35 U.S.C. 154(b) by 0 days.

(21) Appl. No.: 13/716,398

(22) Filed: Dec. 17, 2012

(65) Prior Publication Data

US 2014/0169903 A1 Jun. 19, 2014

(51) Int. Cl.
*B61D 15/00* (2006.01)

(52) U.S. Cl.
CPC ..... *B61D 15/00* (2013.01)
USPC ..... 410/45; 29/897.2

(58) Field of Classification Search
USPC ..... 410/44–47, 53, 2, 36, 101; 280/404, 280/400
See application file for complete search history.

(56) References Cited

U.S. PATENT DOCUMENTS

| | | | | |
|---|---|---|---|---|
| 3,648,622 | A * | 3/1972 | Lich | 410/53 |
| 3,788,237 | A * | 1/1974 | Dieckman et al. | 410/45 |
| 4,041,879 | A * | 8/1977 | Cockrell | 410/45 |
| 4,080,905 | A * | 3/1978 | Cook | 410/45 |
| 4,083,311 | A * | 4/1978 | Wivagg | 410/53 |
| 4,160,420 | A * | 7/1979 | Hackbarth et al. | 410/45 |
| 4,164,906 | A * | 8/1979 | Nieviarovski | 105/392.5 |
| 4,357,878 | A * | 11/1982 | Fedele | 105/159 |
| 4,780,033 | A * | 10/1988 | Walda et al. | 410/1 |
| 5,802,981 | A * | 9/1998 | Kassab | 105/176 |
| 6,286,435 | B1 * | 9/2001 | Kassab et al. | 105/171 |

* cited by examiner

*Primary Examiner* — Glenn Dayoan
*Assistant Examiner* — Sunsurraye Westbrook
(74) *Attorney, Agent, or Firm* — Spradley PLLC; Michael Spradley

(57) ABSTRACT

A system and method for modularization of a Schnabel car is disclosed herein. Specifically disclosed is a modular Schnabel car comprising two Schnabel sections, each connectable to and capable of supporting a load. The Schnabel sections can comprise a Schnabel arm comprising an arm base and arm end, in which the end is connectable to the load. Furthermore, the Schnabel sections can comprise a load spreader having a spreader apex and a plurality of spreader bases and a first quick connect system that connects the arm base to a spreader apex. The load spreader can comprise a span bolster. The first quick connect system can comprise a first connector connected to the arm base and a second connector attached to a spreader apex. The first connector can be mateable with the second connector.

17 Claims, 11 Drawing Sheets

SYSTEM AND METHOD FOR MODULARIZATION OF A SCHNABEL CAR

BACKGROUND

This disclosure relates to a system and method for modularization of a Schnabel car. For purposes of this disclosure, a system and method for a modular Schnabel car are discussed. However, such discussion of a modular Schnabel car is solely exemplary, and not limiting.

Methods for transporting extremely heavy cargo have evolved over the years. With the development of railways, trains and locomotives were also used for transport. Specifically with trains for extremely heavy loads, the Schnabel car system developed into a common practice in the railway transport industry. A Schnabel car includes the attachment of opposing rail cars with the massive cargo attached by a Schnabel arms serving as the main body between the two rail cars.

However, drawbacks to current Schnabel cars include high costs for transport. As a result of the great size of the Schnabel car, the entire train must move at a slow speed, increasing the time of transport. Additional time costs the shipping company money, which is passed on to the business requiring its goods be moved by the Schnabel car.

Thus, it would be useful to have a system and method for modularization of a Schnabel car.

SUMMARY

A system for modularization of a Schnabel car is disclosed herein. Specifically disclosed is a modular Schnabel car comprising two Schnabel sections, each connectable to and capable of supporting a load. The Schnabel sections can comprise a Schnabel arm comprising an arm base and arm end, in which the end is connectable to the load. Furthermore, the Schnabel sections can comprise a load spreader having a spreader apex and a plurality of spreader bases and a first quick connect system that connects the arm base to a spreader apex. The load spreader can comprise a span bolster. The first quick connect system can comprise a first connector connected to the arm base and a second connector attached to a spreader apex. The first connector can be mateable with the second connector.

Additionally, a method for modularization of a Schnabel car is disclosed. Specifically, a method for disassembling a Schnabel car for transport comprising disconnecting a first quick connect system that initially connects an arm base of a Schnabel arm to a spreader apex of a load spreader and removing the Schnabel arm from the load spreader. The method can further comprise disconnecting a second quick connect system that initially connects a spreader base of the load spreader to a bolster apex of a span bolster and removing the load spreader from the span bolster. Finally, the method can comprise setting a Schnabel arm and a load spreader on a rail car.

DETAILED DESCRIPTION

Described herein is a system and method for modularization of a Schnabel car. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
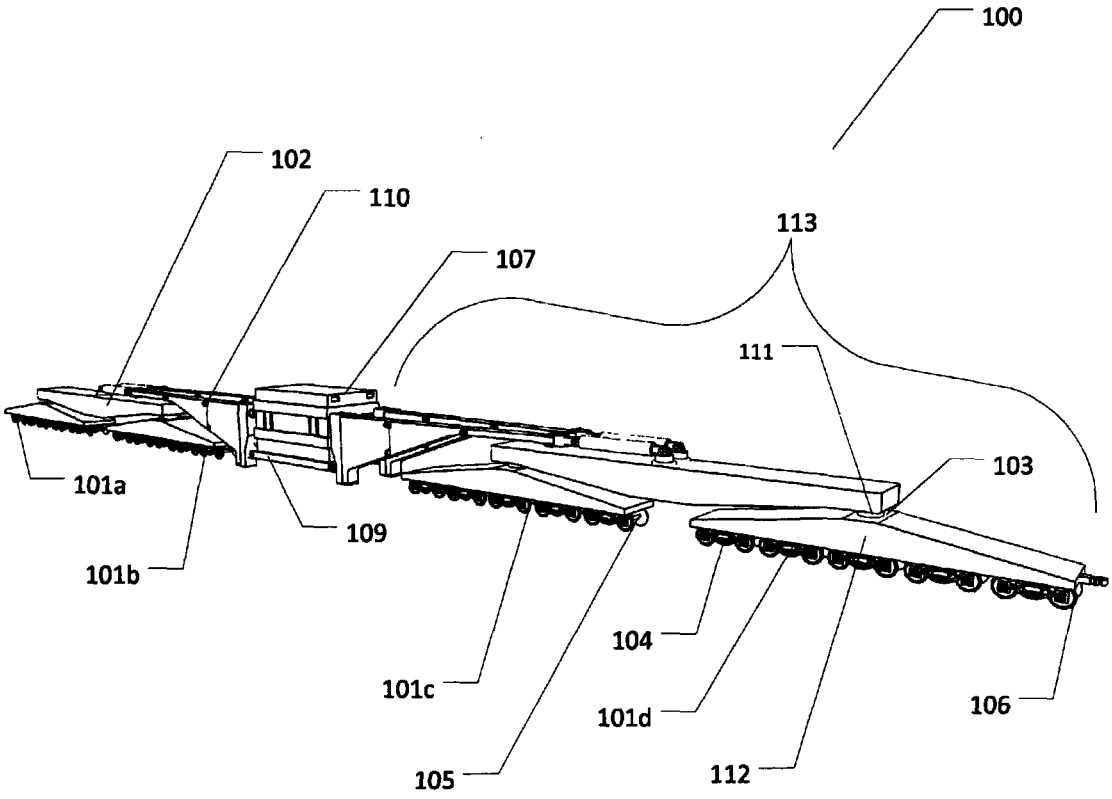
FIG. 1A illustrates a Schnabel car with 40 axles.

FIG. 1A illustrates a Schnabel car 100 with 40 axles 105. Schnabel car 100 can distribute a load over a plurality of separate cars. In one embodiment, Schnabel car 100 can comprise four rail cars 101*a*, 101*b*, 101*c*, 101*d* and a Schnabel superstructure 113. Schnabel superstructure 113 can attach to rail cars 101. Schnabel superstructure 113 can connect to a load 107. In one embodiment, load 107 can sit atop a trailer bed 109. Schnabel car 100 can comprise two Schnabel sections comprising symmetrical halves of the entire Schnabel car 100. Each section can be connectable to load 107, and, when combined together, are capable of supporting the load.

In one embodiment, Schnabel car 100 can comprise an arrangement of multiple rail cars 101 with ten axles 105 by ten axles 105 by ten axles 105 by ten axles 105. Arrangement of multiple rail cars 101 can comprise a running gear that transports load 107 and the entirety of modular Schnabel car 100 along a railway. In another embodiment, two 20-axle rail cars 101 can comprise the running gear of a 40-axle Schnabel car 100.

Rail cars 101 can support the weight of Schnabel superstructure 113. For the purposes of this disclosure, rail car 101 can comprise any number of trucks 104, axles 105, and wheels 106 capable of transport on a railroad track. Each rail car 101 can comprise a bolster base 103. Bolster base 103 can attach trucks 104 to rail cars 101. Trucks 104 can each comprise a group of two or more sets of wheel 106 and axle 105 affixed to bolster base 103.

Superstructure 113 carries and distributes weight of load 107, allowing load 107 to integrate structurally as part of Schnabel car 100. Schnabel superstructure 113 can comprise Schnabel arm 110, a trailer bed 109, pivot pins 111, span bolsters 112, as well as any number of load spreaders 102, beams, compression jacks, cross bars and/or other structural accessories known by a person with ordinary skill in the art. Span bolsters 112 can attach bolster base 103 by hinge pins or any other quick connect device. Hinge pins can be connected to deck of lower bolsters and/or trucks 104 to bottom of span bolsters 112. Pivot pins 111, the cylindrical portion of bolster that rotates on base of span bolsters 112, connects span bolsters 112 to hinge 113 and Schnabel arms 110. Schnabel arm 110 can comprise a Schnabel arm base and end. In one embodiment, parallel beams of Schnabel arm 110 can connect to trailer bed 109 at end of Schnabel arm 110, which carries load 107. At their base, Schnabel arms 110 can comprise a rotating pivot pin 111. Pivot pin 111 can allow Schnabel superstructure 113 to rotate upon bumps and curves during travel. In one embodiment, load spreaders 102 can be added either in place of or on top of span bolsters 109 to accommodate larger loads or other variations of Schnabel car 100. In one embodiment, Schnabel car 100 can comprise a lift. In one embodiment, the lift can be hydraulic, with horizontal side shift movements and/or can have the capability of vertically raising lowering load and supporting arms.

Figure 1B:
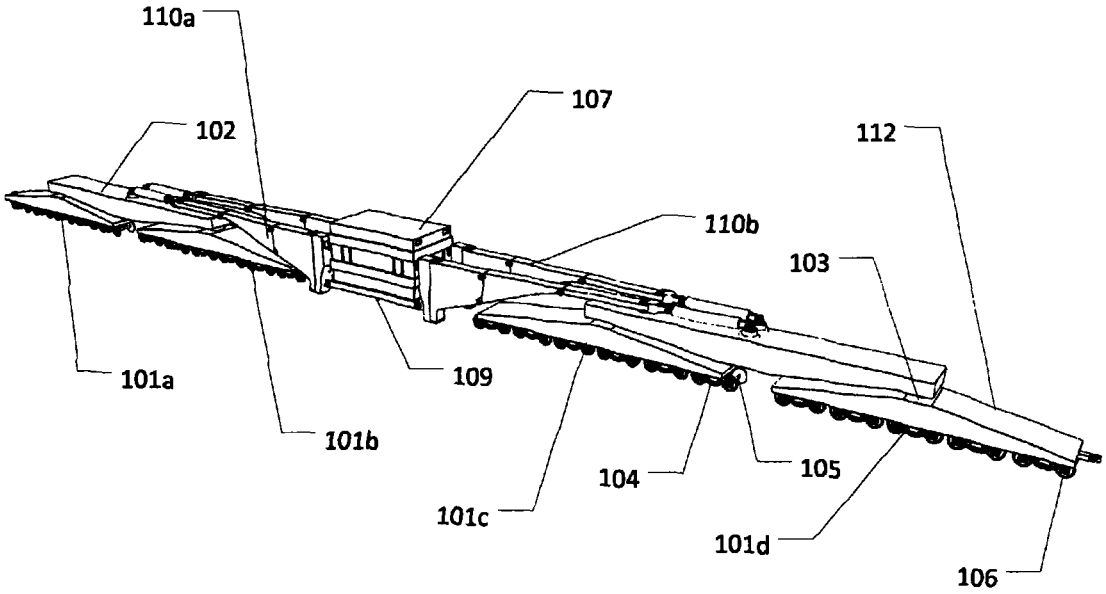
FIG. 1B illustrates a Schnabel car with 44 axles.

FIG. 1B illustrates a Schnabel car 100 with 44 axles 105. In one embodiment, a Schnabel car 100 can comprise an arrangement of multiple rail cars 101 with ten axles 105 by twelve axles 105 by twelve axles 105 by ten axles 105. In one embodiment, the rail cars 101 with ten axles 105 can comprise the outer running gear of Schnabel car 100, while the rail cars 101 with twelve axles 105 can comprise the inner running gear adjacent to the trailer bed 109. In another embodiment, rail cars 101 with twelve axles 105 can be the outer running gear, while rail cars with ten axles 105 can be the inner running gear of Schnabel car 100. Arrangement of multiple rail cars 101 can comprise a running gear that transports load 107 and the rest of Schnabel car 100 across train tracks. In another embodiment, two 22-axle rail cars 101 can comprise the running gear of a 44 axle Schnabel car 100.

Figure 1C:
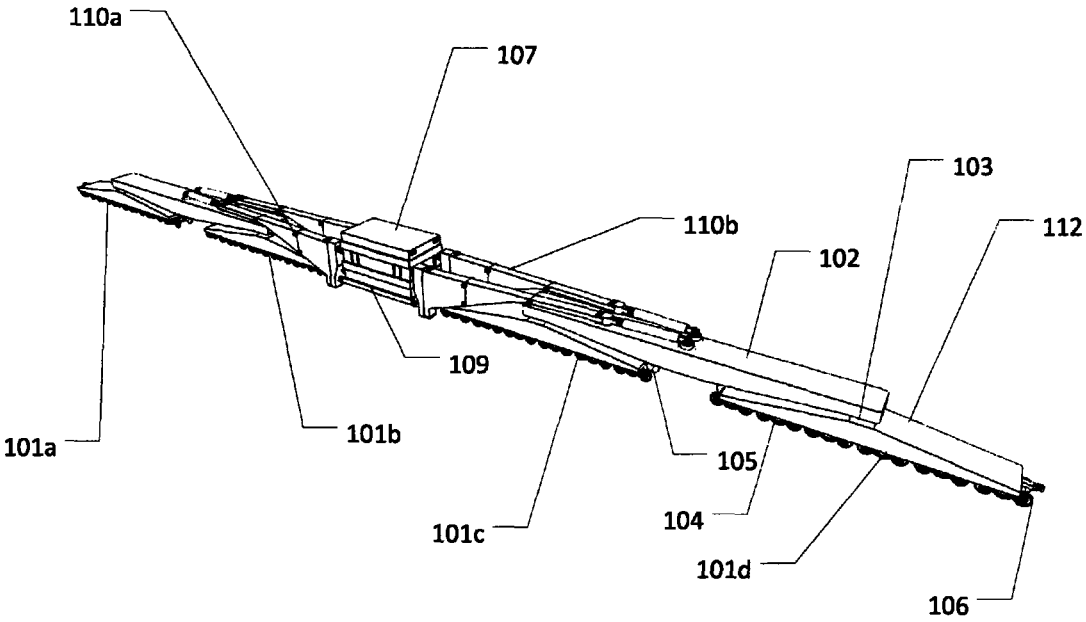
FIG. 1C illustrates a Schnabel car with 48 axles.

FIG. 1C illustrates a Schnabel car 100 with 48 axles 105. In one embodiment, a Schnabel car 100 can comprise an arrangement of multiple rail cars 101 with twelve axles 105 by twelve axles 105 by twelve axles 105 by twelve axles 105. In another embodiment, two 24-axle rail cars 101 can comprise the running gear of a 48 axle Schnabel car 100.

Modularization of Schnabel car 100 involves making the disassembly and reassembly of Schnabel car 100 sufficiently quick and simple that Schnabel car 100 can be reduced to fit on a train within normal transport configuration during a natural period for unloading and loading of the train. An example of a normal transport configuration is Plate F Parameters (17'0" H×10'8" W×46). These dimensions allow for empty positioning of rail car without any special train requirements.

Figure 2A:
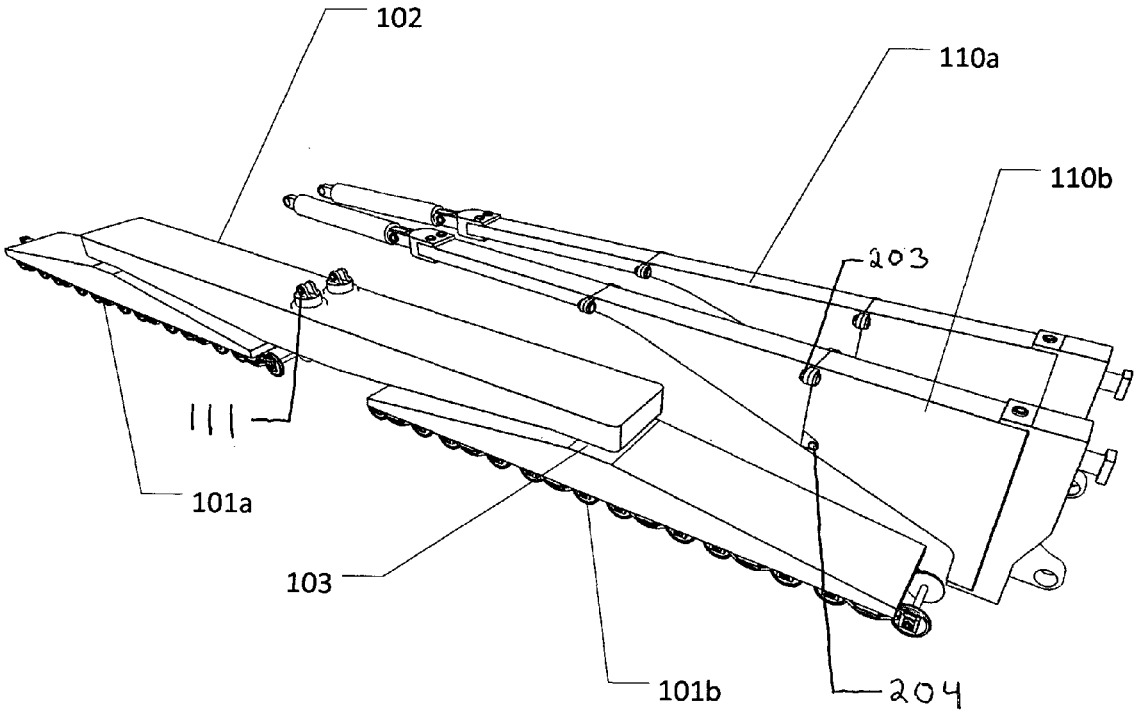
FIG. 2A illustrates a modular Schnabel car with a detached Schnabel arm.

FIG. 2A illustrates a modular Schnabel car 100 with a detached Schnabel arm 110. A modular Schnabel car 100 can be separated at critical junctions that allow for quick disassembly. In larger modular Schnabel cars 100, Schnabel arm 110 can be further modularized. In one embodiment, left Schnabel arm 110*a* and right Schnabel arm 110*b* can be separate pieces. For example, Schnabel arm 110 can comprise a left arm 110*a* and a right arm 110*a*. Furthermore, each Schnabel arm 110 can be assembled and disassembled into smaller arm components with the use of pins or other quick-connect components known in the art. These components of Schnabel arm 110 can be added and removed as modules. In one embodiment, Schnabel arm 110*a* and 110*b* can each comprise three different detachable sections, which can form joints. In one embodiment, joints can comprise bolts 203 with pin hinges 204. In one embodiment, a section can be removed by supporting the section with a crane or other lifting device, unbolting the section, and removing the pin hinge.

Similarly, Schnabel arm 110 can attach at a fitted latch on top surface of load spreaders 102. Latch can have open orifices which can be similar to orifice at tip of Schnabel arms 110. Schnabel arms 110 and latch orifices can be secured together by running a pin or rod, for example, through each orifice. To unfasten, rod and/or pin can be unbolted or otherwise unhinged. Schnabel arms 110 can be secured by crane, prior to unbolting, and lifted up afterwards.

Figure 2B:
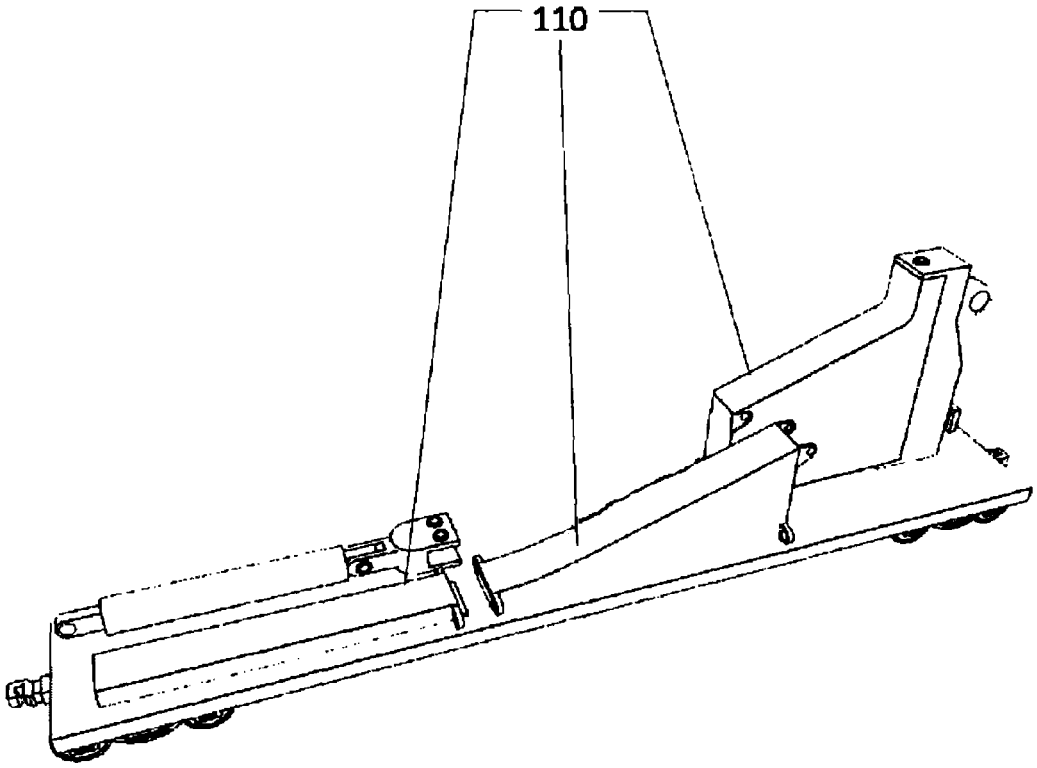
FIG. 2B illustrates a detached Schnabel arm loaded onto a rail car.

FIG. 2B illustrates a detached modular Schnabel arm 110 loaded onto a rail car 110. Once disassembled from modular Schnabel arm, Schnabel arm 110 can be transported by rail cars 110. In one embodiment, Schnabel arm 110 can be folded at joints and/or broken up at section rifts to accommodate storage on rail car 110. Schnabel arm 110 can be placed on individual rail cars 110, separate from other components of modular Schnabel car 100.

For larger embodiments of modular Schnabel car 100, Schnabel arms 110 can be disassembled in several sections into as many as three pieces, for example. In one embodiment, Schnabel arms 110 can be separated into a right Schnabel arm 110*a* and a left Schnabel arm 110*b*. Schnabel arms 110 can be placed onto a singular rail car 101, and fastened as needed for transport.

Figure 2C:
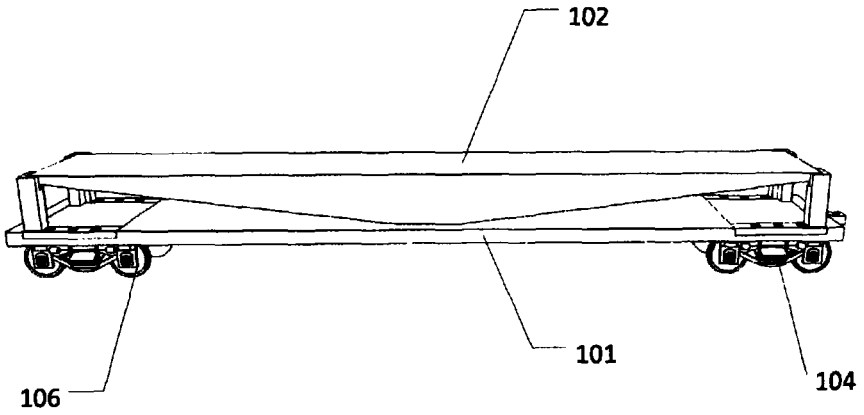
FIG. 2C illustrates a modular Schnabel car with a detached load spreader and a rail car.

FIG. 2C illustrates a modular Schnabel car 100 with a detached load spreader 102 and a rail car. In modular Schnabel car 100, superstructure 113 can comprise load spreaders 102 and/or additional span bolsters 112. Load spreaders 102 can connect either to span bolsters 112 by pins or other quick-connect methods known in the art. Furthermore, additional span bolsters 112 and load spreaders 102 can join to bolster base 103 and/or additional lower bolsters to add more trucks 103 and axles.

A load spreader 102 can comprise an apex and a plurality of spreader bases. Spreader bases can comprise a quick connect attachment that connects arm base of Schnabel arm 110 to spreader apex. The quick connect attachments on both ends of spreader bases and a quick connect system that connects said arm base to said spreader apex.

During disassembly, load spreaders 102 can be lifted by crane. A crane can support load spreaders 102, while pins can be removed and load spreaders 102 can be unbolted. Once unhinged load spreaders 102 can be removed. In another embodiment, cranes can be used to support any and all other components of modular Schnabel car 100 during unfastening and, also lift and place components as a load 107 onto rail cars 101.

In one embodiment, load spreaders 102 can be loaded onto a rail car 101 adapted to support load spreader 102. Rail car 101 can have two singular columns 200 at each end of its surface. In one embodiment, columns 200 can be mounted to a plate 201, which slides into a slot on each end of rail car 101. Furthermore, column 200 can, in one embodiment have indentions 202 at corners adjacent to inside surface of rail car 101. In such embodiment, outer corners of indentations 202 can raise up higher than inner corners. As a result, edges of load spreader 102 can be fitted to columns 200 within the indentation 202 of columns 200. In one embodiment, load spreader 102 can be held up by columns 200 above surface and fastened securely to rail car 101 as needed. In another embodiment, load spreader 102 can have protruding cylinders removed as needed to securely fit to columns 200.

Figure 2D:
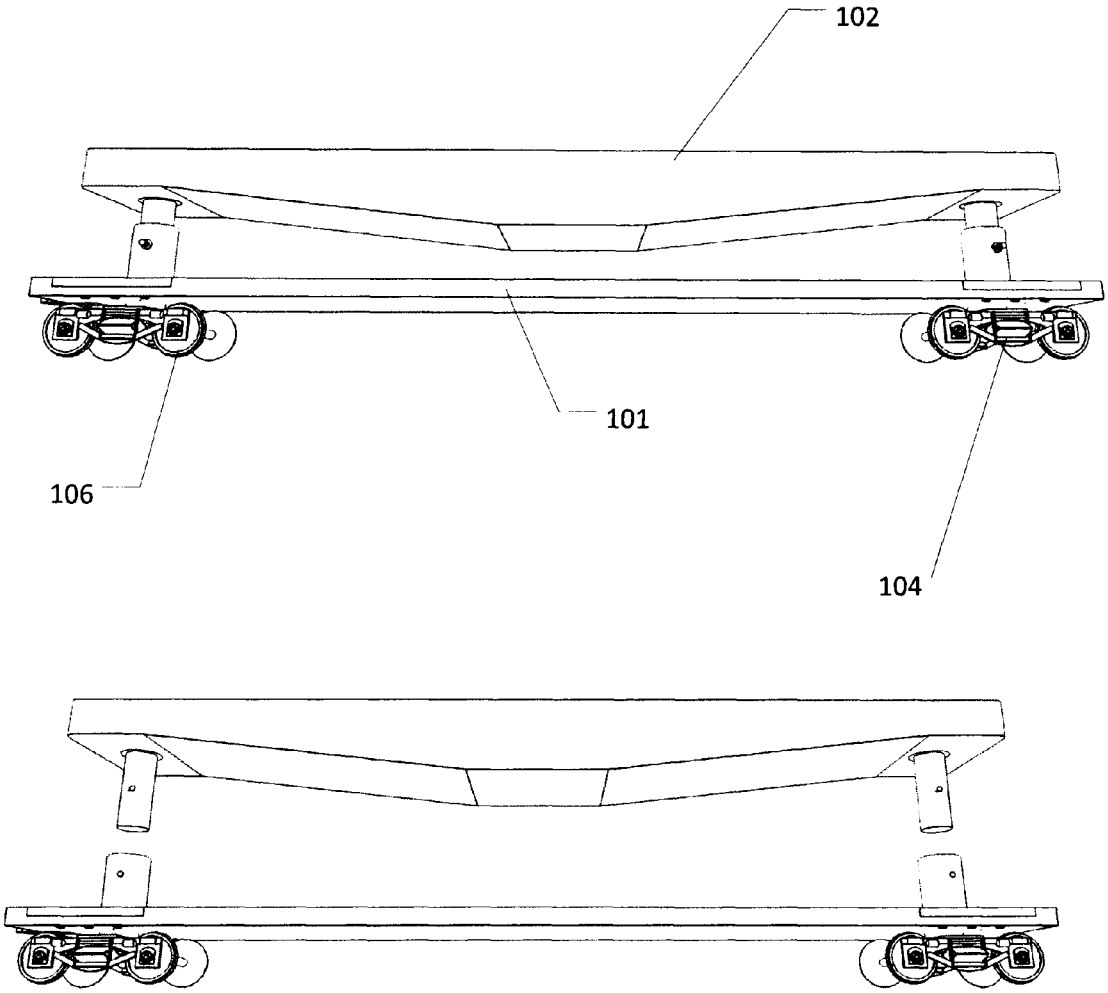
FIG. 2D illustrates a load spreader loaded onto a rail car.

FIG. 2D illustrates an embodiment of load spreaders 102 loaded onto rail car. In one embodiment, load spreaders 102 can latch securely onto rail car 101 through cylinders on ends, which originally latched onto holes atop span bolsters 109.

Plates 201 that are placed in slots on opposed ends of rail car 101 can have a cylindrical orifice, into which load spreader cylinders can fit.

Figure 2E:
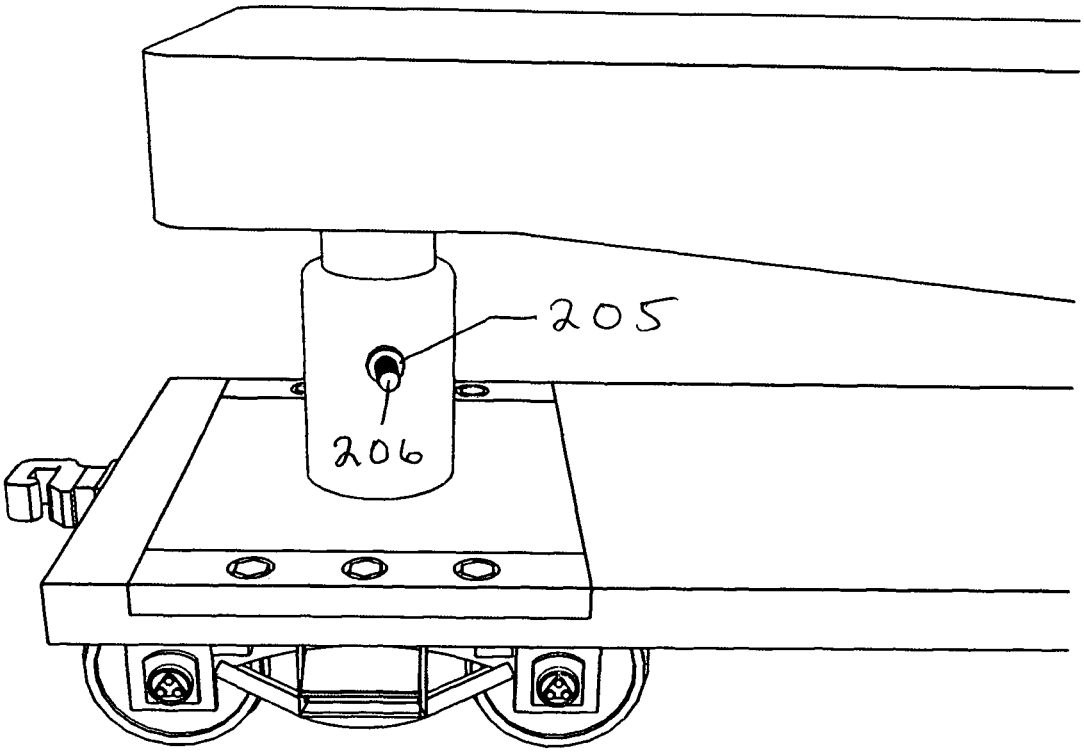
FIG. 2E illustrates an embodiment of load spreader loaded onto a rail car.

FIG. 2E illustrates a close up view of load spreader 102 attached to rail car 101. As load spreader 102 is placed upon surface of rail car 101, cylinders on opposing ends of load spreader 102 can be mated to a plate orifice 202 on ends of rail car 101. Plate orifice 202 can comprise a hole or a raised cylinder into which cylinders of load spreader 102 can be mated. In one embodiment, male/female quick connections can be utilized. To further secure mated connection, apertures 205 can be drilled into sides of cylinder embodiment, as rod 206 can be inserted through apertures 205.

Figure 3A:
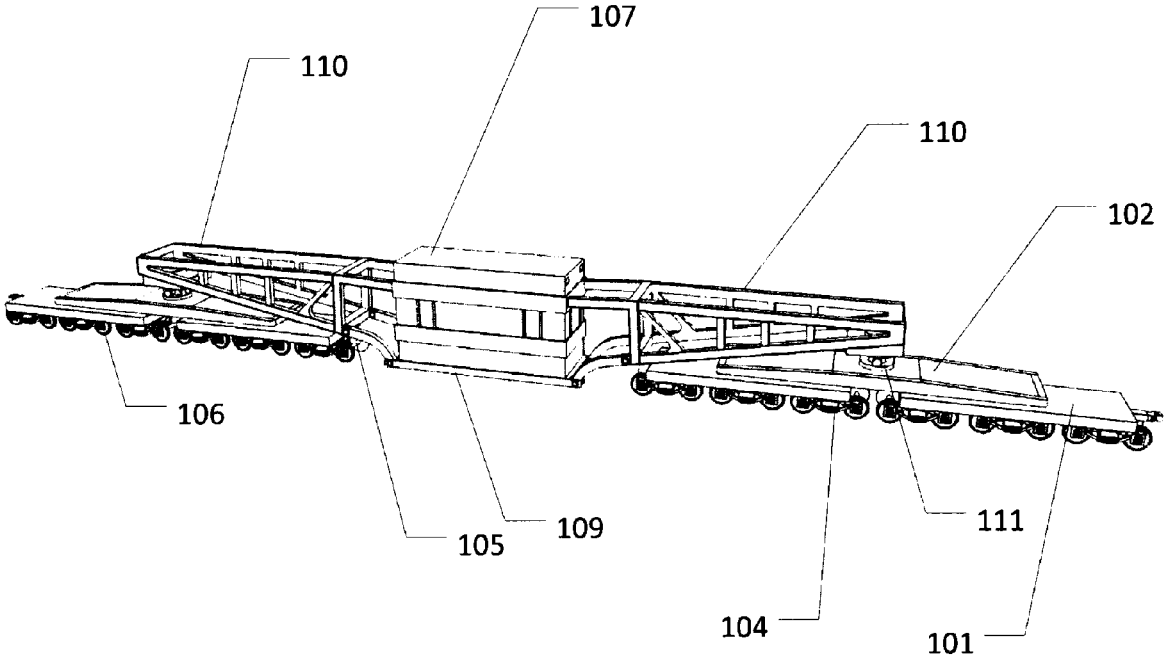
FIG. 3A illustrates a modular Schnabel car with 24 axles.

FIG. 3A illustrates a modular Schnabel car with 24 axles. A modular 24-axle Schnabel car 100, in one embodiment, can comprise the following modules: four railcars 101, four span bolsters 112 each positioned on top of railcars 101, two load spreaders 102, each positioned above two span bolsters 112, and two Schnabel arms 110 modularized as discussed above. Modules can be added and removed as needed to accommodate transport of Schnabel car 100 with or without load 107. Modular pieces, such as load spreaders 102, span bolsters 112, superstructure 113, which includes Schnabel arms 110, trailer bed 109, any other parts of the load support assembly and other cargo securing accessories and attachments can be removed as modules at crucial points by unhinging, unbolting or unfastening from rail car 101 as attached.

Figure 3B:
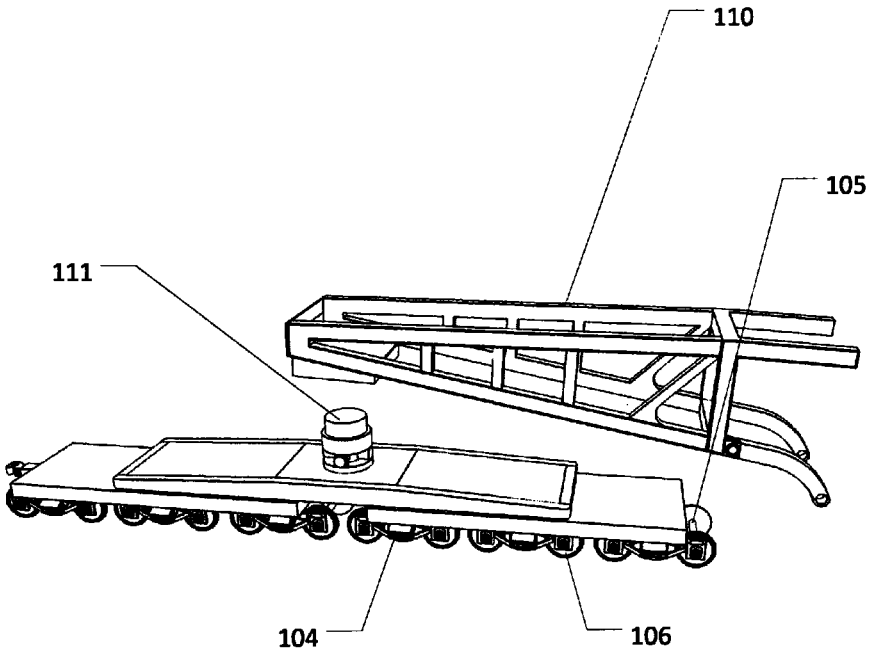
FIG. 3B illustrates a modular Schnabel car with 24 axles and a removed portion of superstructure.

FIG. 3B illustrates a modular Schnabel car with 24 axles and a removed portion of superstructure 113. Schnabel superstructure 113 can be removed in pieces. Modularization of modular Schnabel car 100 can consist of disassembling superstructure from Schnabel car 100 to make remaining length of modular Schnabel car 100 smaller. After load 107 is transported to its arrival destination, Schnabel superstructure 113 can be detached from bolster rail cars 101. Disassembly and reassembly of modular Schnabel car 100 can make it smaller, more easily maneuverable, less costly to transport and released from certain restrictions, such as speed restrictions, along any further transport.

Components of modular Schnabel car 100 can be disassembled for normal transport. In such embodiment, Schnabel arm 110 can be detachable from span bolster 112 at pivot pin 111. Additionally, each Schnabel arm 110 can be disconnected from trailer bed 109 if such configuration comprises trailer bed 109. Superstructure 113 can be removed by unfastening and/or unbolting components from base of modular Schnabel car 100. Schnabel arms 110 can be unhinged from trailer bed 109 at various hinges. Load spreaders 102 can be detached from pins and pivot pins 111 by unbolting onsite.

Figure 3C:
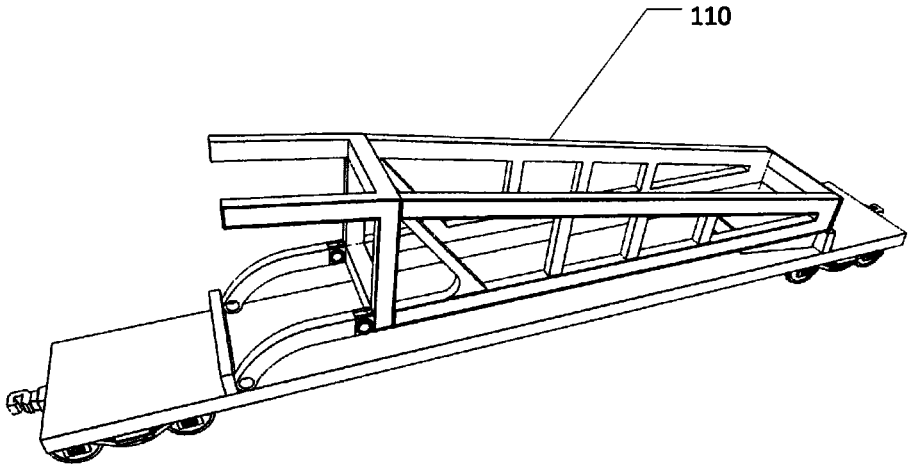
FIG. 3C illustrates a portion of Schnabel superstructure loaded onto rail cars.

FIG. 3C illustrates a portion of Schnabel superstructure 113 loaded onto rail cars 101. Depending on the weight of load 107, additional components of Schnabel car 100 can be added or reassembled in different combinations to optimize transport. Specifically, various embodiments of rail cars 101 can be added to Schnabel car 100. In one embodiment, rail cars 101 can comprise one bolster base 103 and/or lower bolsters attaching all trucks 104, axles 105 and wheels 106. Additionally, in one embodiment, rail cars 101 can comprise bolster bases 103 and/or multiple lower bolsters attaching to different combinations/groups of trucks 104, axles 105 and wheels 106.

As axles 105 support weight distribution, various embodiments of trucks 104 and axles 105 groupings can be utilized in modular Schnabel car 100 as well. In one embodiment, bolster base 103 and/or lower bolsters can connect trucks 104 and axles 105 in sets of four wheels 106 with two axles 105. In another embodiment, bolster base 103 and/or lower bolsters can connect trucks 104 and axles 105 in sets of six wheels 106 with three axles 105. Axles 105 can be spread apart at various lengths for support of weight distribution. In one embodiment, each axle 105 can support at least 78,000 lbs.

Also, the arrangement of trucks 104 and axles 105 can also improve maneuverability when Schnabel car 100 negotiates turns on railroad tracks. In some embodiments, additional axles 105 can be attached to rail car 101 by bolting, fastening, welding or other methods used by a person with ordinary skill in the art. Removable couplings can enjoin multiple rail cars 101 to add any number of axles 105. As more weight support is necessary to transport heavier cargo loads 107, a higher amount of axles 105 in rail cars 101 can be necessary for both distribution of weight and securing of modular Schnabel car 100 with load 107 in transit. Aside from weight distribution, maneuverability of modular Schnabel car 100 can be considered in determining number of axles 105 and arrangement of rail cars 101 and bolster base 103. For example, multiple groups of axles 105 and trucks 104 joined by multiple bolster bases 103 and/or lower bolsters can make turns easier to negotiate than, for example, having several axles 105 joined together at fewer bolster bases 103 and/or lower bolsters. Each bolster base 103 can adjoin the axle lines. Specifically, bolster bases 103 and/or lower bolsters form the structural connection between two or more adjacent trucks 104 and link them.

After removal of superstructure 113, multiple rail cars 101 can remain as running gear for transportation of the disassembled parts. In one embodiment, separate rail cars 101 can be transported with modular Schnabel car 100. In another embodiment, rail cars 101 can result from the disassembly of modular Schnabel car 100 and can be connected with the additional separate rail cars 101 to accommodate the fitting of all components of modular Schnabel car 100. Bolster base 103 and/or lower bolsters remain attached to trucks 104, axles 105 and wheels 106. Rail cars 101 can comprise multiple bolster bases 103, in one embodiment, or one solid bolster base 103 across all trucks 104, axles 105 and wheels 106. Rail cars 101 can still individually function as load bearing flat cars movable on a train track. Rail cars 101, if necessary, can individually travel to next destination. Additionally, rail cars 101 can individually act as a transporting vehicle capable of supporting weight on their surface.

For weight support and transportation convenience, separate rail cars 101 can be reassembled and attached together as one car. One end of rail car 101A can be affixed to a separate end of another bolster rail car 101B. Rail cars can comprise four axles 105, with two trucks 104. In one embodiment, the rail cars 101 can be assembled prior to the loading components of superstructure 113, in accordance with the preference of user. In another embodiment, the assembly of rail cars 101 can occur after the loading components of superstructure 113 onto individual rail cars 101. In one embodiment, Schnabel arms 110 can be placed on separate rail cars 101.

Couplings can be used to attach two separate bolster rail car 101 units together. Couplings can be removable, in one embodiment. In one embodiment, couplings can be attached between trucks 104 and/or axles 105 which were once directly adjacent to trailer bed 109. As a result, modular Schnabel car 100 can be reassembled as a functional load-bearing railway car 101. In one embodiment, multiple rail cars 101 can combine as a functional flat car or a heavy duty flat car. After reassembly, modular Schnabel car 100 can be decreased in size approximately by at least the same length as trailer bed 109, in one embodiment, while railway car 101 can be made to take up even less surface area on tracks in other embodiments. This reduction in size can allow for better maneuverability on track. The joining of both railcars 101 can allow for convenience in transporting one piece instead of two separate pieces. Furthermore, the joining of both railcars 101 allows for a greater amount of weight capacity and facilitation of weight distribution.

Rail cars 101 can be modified with quick connects or other devices involving the mating of male inserts and female connectors to securely fasten different components of modular Schnabel car 100. For example, as crane lifts load spreaders 102 onto rail car 101, load spreaders 102 can be securely fastened to raised edges added to surface edges of rail car 101, in one embodiment. Raised edges can protrude upwards and inwards, like raised hooks, for example, so as to securely clasp opposite ends of load spreaders 102. Similarly, load spreaders 102 can have clips on end which attach to rail car 101 and/or raised edges.

In one embodiment, joined rail cars 101 carrying Schnabel superstructure 113 as load 107. In its flat car variation as railway car 101, modular Schnabel car 100 can act as a load-carrying transport for not only Schnabel arms 110, but any other disassembled modular pieces at the preference of user. The mechanics of assembly can comprise methods used by a person with ordinary knowledge and skill in the art. The loading and securing of all components can be placed upon and fastened securely as needed on flatcar variation of joined rail cars 101 as needed. Bolting, fastening of components of superstructure 113 and other methods known by a person with ordinary skill in the art can be utilized. Furthermore, components of superstructure 113 can be strategically distributed on top of surface, as structures can be organized and spread out among axles 105 to optimize support and avoid surpassing capacity.

In one embodiment, two joined rail cars 101 can carry detached axles 105 and Schnabel superstructure 113 with reduced axles 105 as a load 107. To further decrease size of original modular Schnabel car 100, reduce expenses on transport regulation fees for oversized loads 107 and avoid restrictions and special car requirements, conjoined rail cars 101 can be reduced to an appropriate axle length for transportation. Any number of trucks 104 and/or axles 105 can be removed from rail car 101 and placed on top securely with the rest of superstructure 113, trailer bed 109. Even partial trucks 104 can remain functional as only partial sets of wheels 106 and axles 105 can be removed and placed along with the rest of modular Schnabel car 100.

Once load 107 has been delivered and disassembled modular Schnabel car 100 has transported components of superstructure 113 to final destination, modular Schnabel car can become a reassembled modular Schnabel car 100. Once modular Schnabel car 100 is needed to carry another load 107, rail car 101 can be separated at each rail car 101 module or disassembled accordingly. Afterwards, rail cars 101 can be reassembled, as superstructure 113 can be reattached to form original or similar version of modular Schnabel car 100. Couplings can be removed, as needed and links between rail cars 101 can be unfastened, unbolted or unhinged. Afterwards, pins or fasteners can be bolted in and span bolsters 112 can be reattached to deck of bolster base 103 and/or lower bolsters. Load spreaders 102 can be reattached to span bolsters 112 and/or bolster base 103 by crane and/or methods known by a person with ordinary skill in the art. Schnabel arms 110 can be reattached to bolster base 103 at pivot pin 111 of railway car 101.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A modular Schnabel car comprising two Schnabel sections, each said Schnabel section connectable to a load, said Schnabel sections together capable of supporting said load, said Schnabel sections each comprising a Schnabel arm comprising an arm base and an arm end, said end connectable to said load, said Schnabel arm comprising a first portion and a second portion, said first portion connected to a second portion by a first quick connect system, said first quick connect system consisting essentially of a pin hinge and a plurality of fasteners;

a load spreader having a spreader apex and a plurality of spreader bases; and a second quick connect system that connects said arm base to said spreader apex.

2. The modular Schnabel car of claim 1, wherein said load spreader comprises a span bolster.

3. The modular Schnabel car of claim 2, wherein said modular Schnabel car further comprises a plurality of railcars connected to said span bolster.

4. The system in claim 1, wherein said second quick connect system consists essentially of two or fewer pivot pins.

5. The modular Schnabel car of claim 1 further comprising a plurality of span bolsters, each of said span bolsters comprising a bolster apex connected to at least one of said spreader bases.

6. The modular Schnabel car of claim 5 further comprising a third quick connect system that connects at least one of said spreader bases to said bolster apex.

7. The modular Schnabel car of claim 5 further comprising a plurality of bolster rail cars connected to said span bolsters.

8. The modular Schnabel car of claim 7, wherein each of said bolster rail cars comprises ten axles.

9. The modular Schnabel car of claim 7, wherein each of said bolster rail cars comprises twelve axles.

10. The modular Schnabel car of claim 7, wherein two of said bolster rail cars comprise ten axles and two of said bolster rail cars comprises twelve axles.

11. A method for disassembling for transport a modular Schnabel car comprising disconnecting a second quick connect system that initially connects an arm base of a Schnabel arm to a spreader apex of a load spreader;

removing said Schnabel arm from said load spreader; and disconnecting a first quick connect system that connects a first portion of said Schnabel arm to a second portion of said Schnabel arm.

12. The method in claim 11, wherein said load spreader comprises a span bolster.

13. The method of claim 11, further comprising the steps disconnecting a third quick connect system that initially connects a spreader base of said load spreader to a bolster apex of a span bolster; and removing said load spreader from said span bolster.

14. The method of claim 13, wherein disconnecting said third quick connect system consists essentially of removing one or more second pins.

15. The method of claim 13 further comprising the step of setting said load spreader on a rail car.

16. The method of claim 11, wherein disconnecting said second quick connect system consists essentially of removing a first pin.

17. The method of claim 11 further comprising the step of setting said Schnabel arm on a rail car.

* * * * *